US007458351B2

(12) United States Patent
Takenaka et al.

(10) Patent No.: US 7,458,351 B2
(45) Date of Patent: Dec. 2, 2008

(54) VALVE TIMING CONTROLLER

(75) Inventors: Akihiko Takenaka, Anjo (JP); Eiji Isobe, Kariya (JP); Takayuki Inohara, Okazaki (JP); Yoshihito Moriya, Nagoya (JP); Takashi Inoue, Toyota (JP); Koichi Shimizu, Toyota (JP)

(73) Assignees: Denso Corporation (JP); Nippon Soken, Inc. (JP); Toyota Jidosha Kabushiki Kaisha (JP)

( * ) Notice: Subject to any disclaimer, the term of this patent is extended or adjusted under 35 U.S.C. 154(b) by 27 days.

(21) Appl. No.: 11/798,548

(22) Filed: May 15, 2007

(65) Prior Publication Data

US 2007/0266977 A1 Nov. 22, 2007

(30) Foreign Application Priority Data

May 18, 2006 (JP) ..... 2006-139468

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 464/1, 2, 160
See application file for complete search history.

(56) References Cited

U.S. PATENT DOCUMENTS 6,883,482 B2 4/2005 Takenaka et al.
7,395,791 B2 * 7/2008 Isobe ..... 123/90.17

FOREIGN PATENT DOCUMENTS

JP 2005-48706 2/2005

* cited by examiner

*Primary Examiner*—Ching Chang
(74) *Attorney, Agent, or Firm*—Nixon & Vanderhye PC

(57) ABSTRACT

A valve timing controller includes a guide rotation member provided with a guide groove, a bearing rotation member radially supporting the guide rotation member, and a plurality of movable bodies sliding in the guide groove in accordance with a rotation of the guide rotation member. A plurality of link mechanisms connects the bearing rotation member with each one of movable bodies respectively, and rotates the bearing rotation member in accordance with a movement of the movable bodies. The valve timing of at least one of the intake valve and the exhaust valve is adjusted in accordance with a rotation of the bearing rotation body. A clearance gap is provided between the guide rotation member and the bearing rotation member in order to permit a relative radial movement of the guide rotation member with respect to the bearing rotation member.

12 Claims, 16 Drawing Sheets

VALVE TIMING CONTROLLER

CROSS-REFERENCE TO RELATED APPLICATION

This application is based on Japanese Patent Application No. 2006-139468 filed on May 18, 2006, the disclosures of which is incorporated herein by reference.

FILED OF THE INVENTION

The present invention relates to a valve timing controller which adjusts valve timing of at least one of an intake valve and an exhaust valve.

BACKGROUND OF THE INVENTION

JP-2005-048706A shows a valve timing controller which includes a guide rotation member provided with guide grooves, a plurality of movable bodies sliding in the guide grooves, and a bearing rotation member radially supporting the guide rotation member. A plurality of link mechanisms connects the moveable bodies with the guide rotation member. Since each element in a motion transfer system from the guide rotation member to the bearing rotation member constructs a constrained chain, operational conditions of each element are defined according to its valve timing.

Between the guide rotation member and the bearing rotation member, a radial clearance gap is formed to permit a relative rotation. A radial displacement may be arouse due to a manufacturing tolerance between the guide rotation member and the bearing rotation member. In a case that the clearance gap is excessively small, each rotation member collides with each other, so that the guide rotation member may stick on the bearing rotation member, and an operation lock and a reduction in strength may be arouse. Besides, a clearance gap is formed in width direction between an inner surface of the guide groove and the movable member. Even if one of the movable bodies is engaged with the guide groove, the other movable body may not be engaged with the guide groove. In this case, operation load is concentrated on the movable members or the link mechanisms, which may cause a reduction in strength.

SUMMARY OF THE INVENTION

The present invention has been made in view of the foregoing problem. It is an object of the present invention to provide a valve timing controller which avoids an operation lock and a reduction in strength.

According to the present invention, the valve timing controller includes a guide rotation member provided with a guide groove, a bearing rotation member radially supporting the guide rotation member, and a plurality of movable bodies sliding in the guide groove in accordance with a rotation of the guide rotation member. A plurality of link mechanisms connects the bearing rotation member with each one of movable bodies respectively, and rotates the bearing rotation member in accordance with a movement of the movable bodies. The valve timing of at least one of the intake valve and the exhaust valve is adjusted in accordance with a rotation of the bearing rotation body. A clearance gap is provided between the guide rotation member and the bearing rotation member in order to permit a relative radial movement of the guide rotation member with respect to the bearing rotation member.

DETAILED DESCRIPTION OF THE PREFERRED EMBODIMENTS

Figure 1:
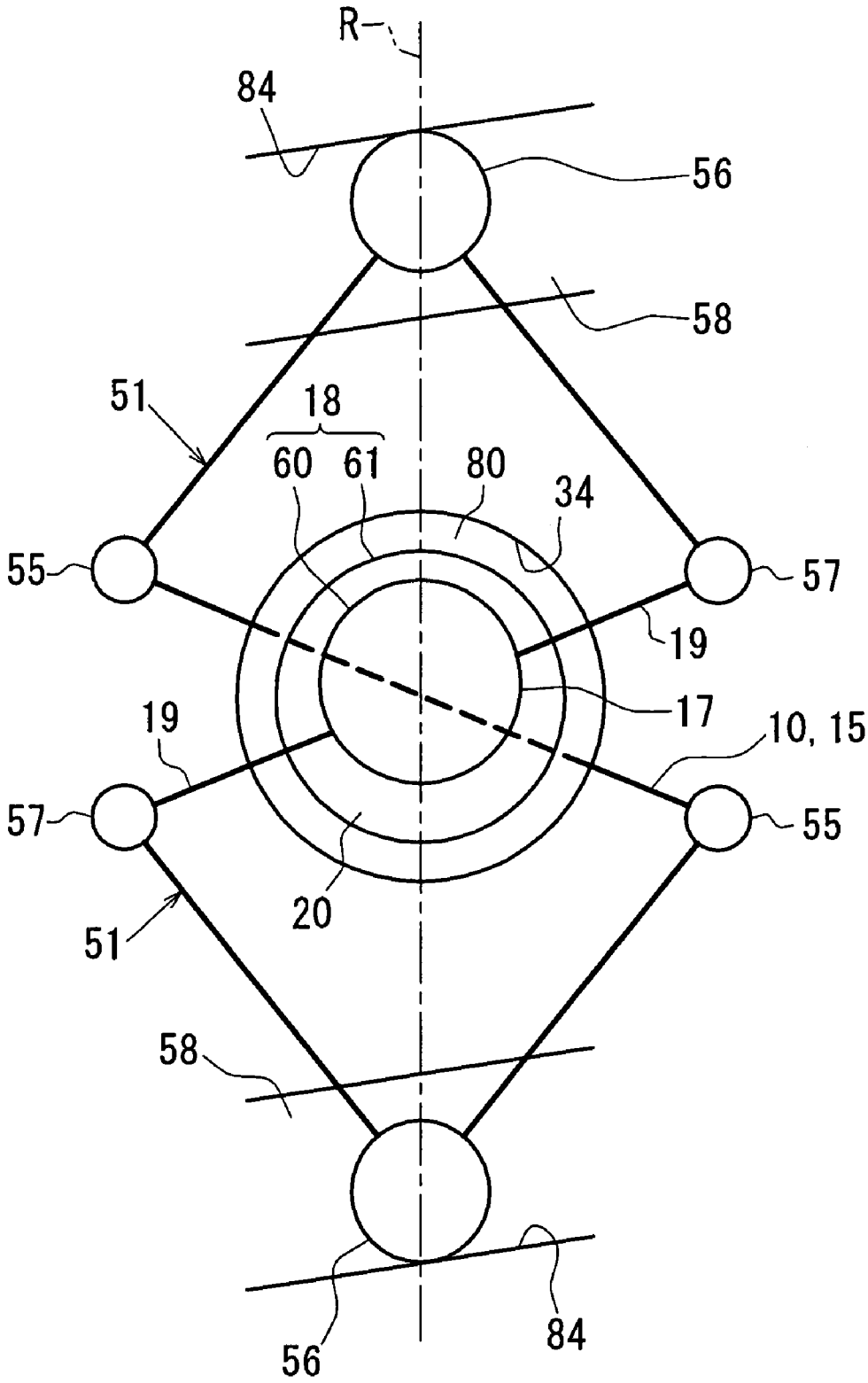
FIG. 1 is a schematic view showing a structural feature of a first embodiment.

Embodiments of the present invention will be described hereinafter. The same parts and components as those in each embodiment are indicated with the same reference numerals and the same descriptions will not be reiterated.

First Embodiment

Figure 2:
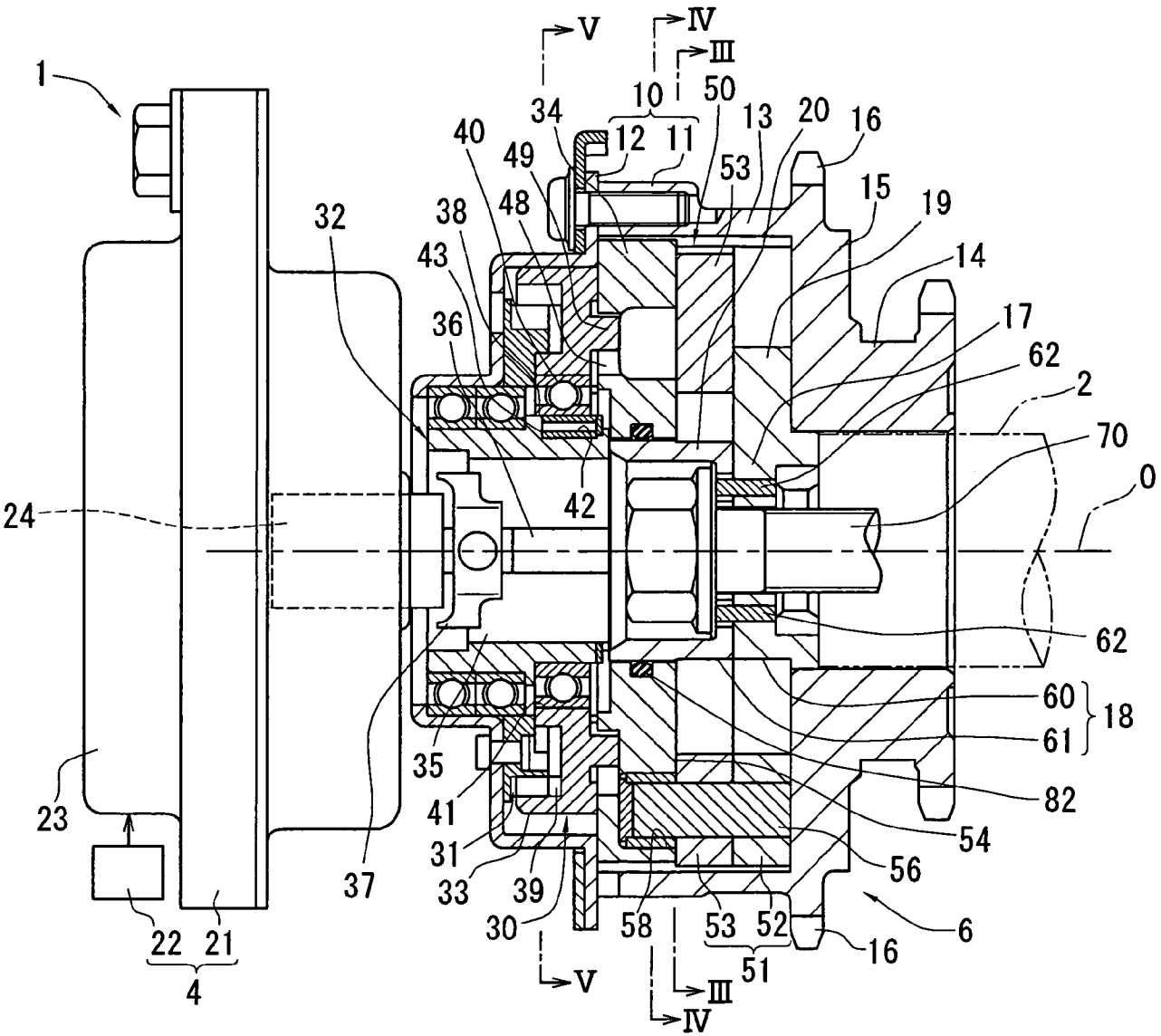
FIG. 2 is a cross sectional view showing a valve timing controller, taken along a line II-II in FIG. 3.

FIG. 2 is a cross sectional view of a valve timing controller 1. The valve timing controller 1 is provided in a torque transfer system which transfers the torque of a crankshaft (not shown) to a camshaft 2 of an engine. The valve timing controller 1 adjusts a rotational phase of a driven rotation member 18 which rotates with the camshaft 2 relative to a driving rotation member 10 which rotates with the crankshaft, whereby a valve timing of an intake valve is adjusted. The valve timing controller 1 includes an electric control system 4 and a phase change mechanism 6.

The electric control system 4 is provided with an electric motor 21 and an electric current control circuit 22. The electric motor 21 is a brushless motor which has a motor case 23 and a motor shaft 24. The motor case 23 is fixed to the engine through a stay (not shown), and the motor shaft 24 is supported by the motor case 23. The electric current control circuit 22 includes an operation driver and a microcomputer, and is electrically connected with the electric motor 21. The electric current control circuit 22 controls electric current applied to the motor 21 according to a driving condition of the engine. The electric motor 21 generates a magnetic filed around the motor shaft 24 to generate rotation torque in X direction or Y direction (refer to FIG. 5). The rotation torque generated by the motor 21 is referred to as a motor torque, hereinafter.

The phase change mechanism 6 is provided with the driving rotation member 10, the driven rotation member 18, a reduction gear unit 30, and a link unit 50.

Figure 3:
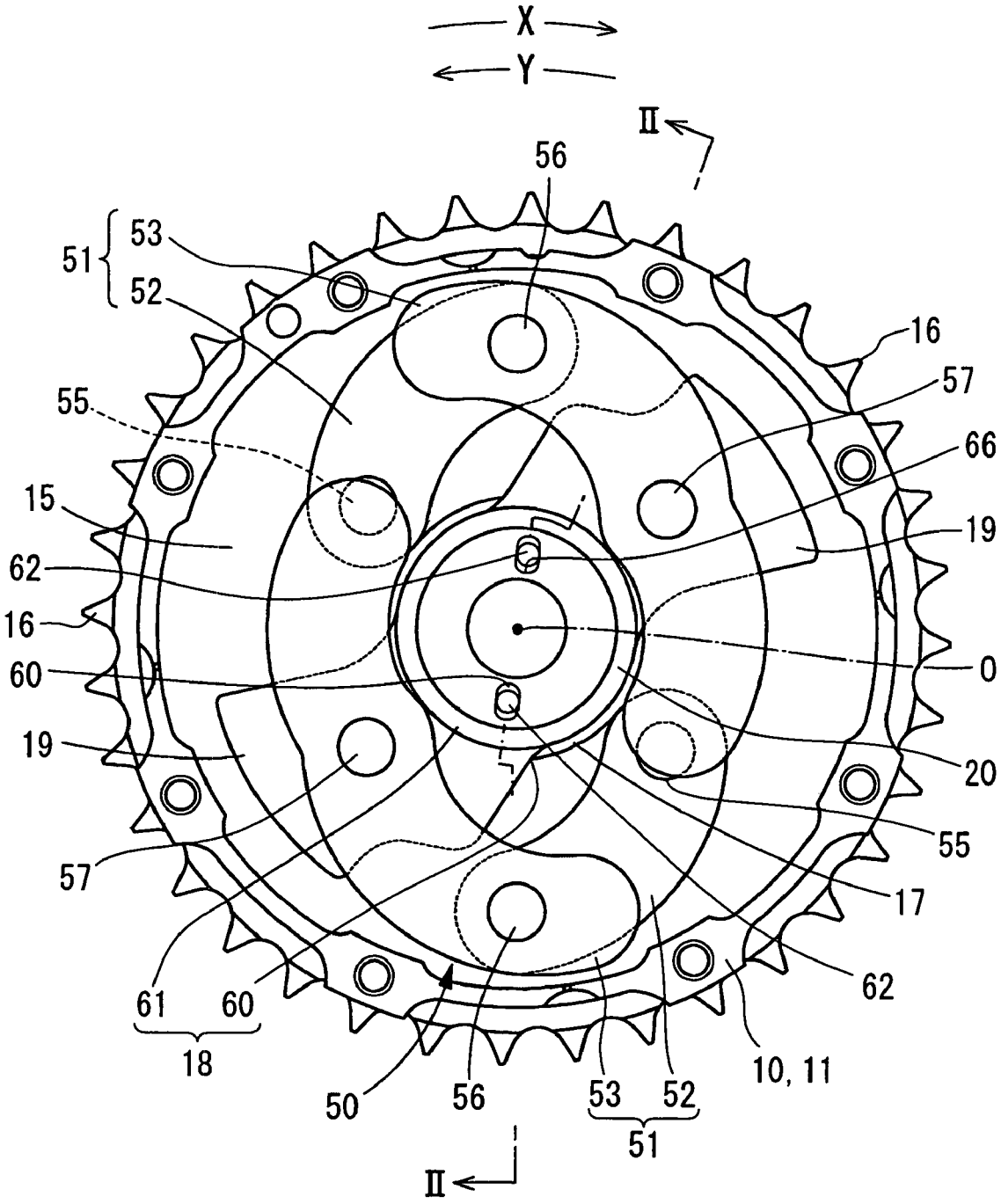
FIG. 3 is a cross sectional view taken along a line III-III in FIG. 2.
Figure 4:
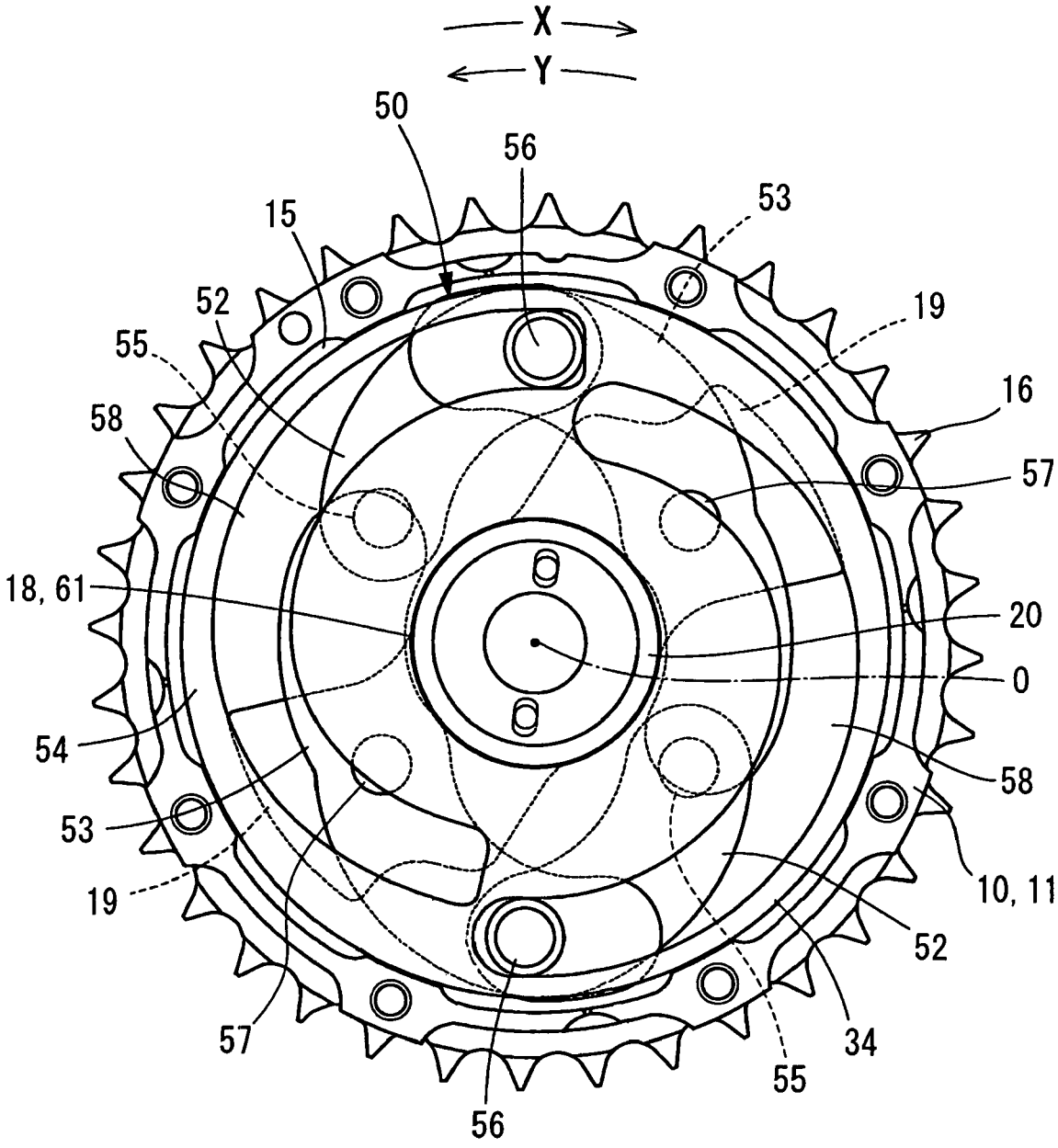
FIG. 4 is a cross sectional view taken along a line IV-IV if FIG. 2.

As shown in FIGS. 2 to 4, the driving rotation member 10 accommodates the reduction gear unit 30 and the link unit 50, and the like. The driving rotation member 10 includes a sprocket 11 and a cover 12. The sprocket 11 and the over 12 are fixed on the same axis by a screw. The sprocket 11 includes a large diameter portion 13, a small diameter portion 14, and an intermediate portion 15. The intermediate portion 15 is provided with a plurality of teeth 16 on its outer periphery. A timing chain is wound between the teeth 16 and teeth of the crankshaft. When the engine torque is transmitted to the sprocket 11, the driving rotation member 10 rotates around a rotation center "O" while maintaining the same rotational phase as the crankshaft. The driving rotation member 10 rotates in a clockwise direction in FIGS. 3 and 4.

As shown in FIGS. 2 and 3, the driven rotation member 18 includes a fix portion 17, a pair of connecting portions 19, and a bearing portion 20. The fix portion 17 is cylindrical and is arranged coaxially with the driving rotation member 10. The fix portion 17 is rotatably engaged with an inner surface of the intermediate portion 15. The driven rotation member 18 supports the driving rotation member 10 in its radial direction. The fix portion 17 is coaxially connected to the camshaft 2. Thereby, the driven rotation member 18 is able to rotate around the center "O" while maintaining the same rotational phase as to the camshaft 2, and is able to relatively rotate with respect to the driving rotation member 10. The direction in which the driven rotation member 18 advances relative to the driving rotation member 10 is denoted by "X", and the direction in which the driven rotation member 18 retards relative to the driving rotation member 10 is denoted by "Y".

The connecting portions 19 are integrally connected to the fix portion 17 at 1800 rotationally symmetrical points with respect the center "O". The cylindrical bearing portion 20 is arranged opposite to the camshaft 2 with respect to the fix portion 17.

Figure 5:
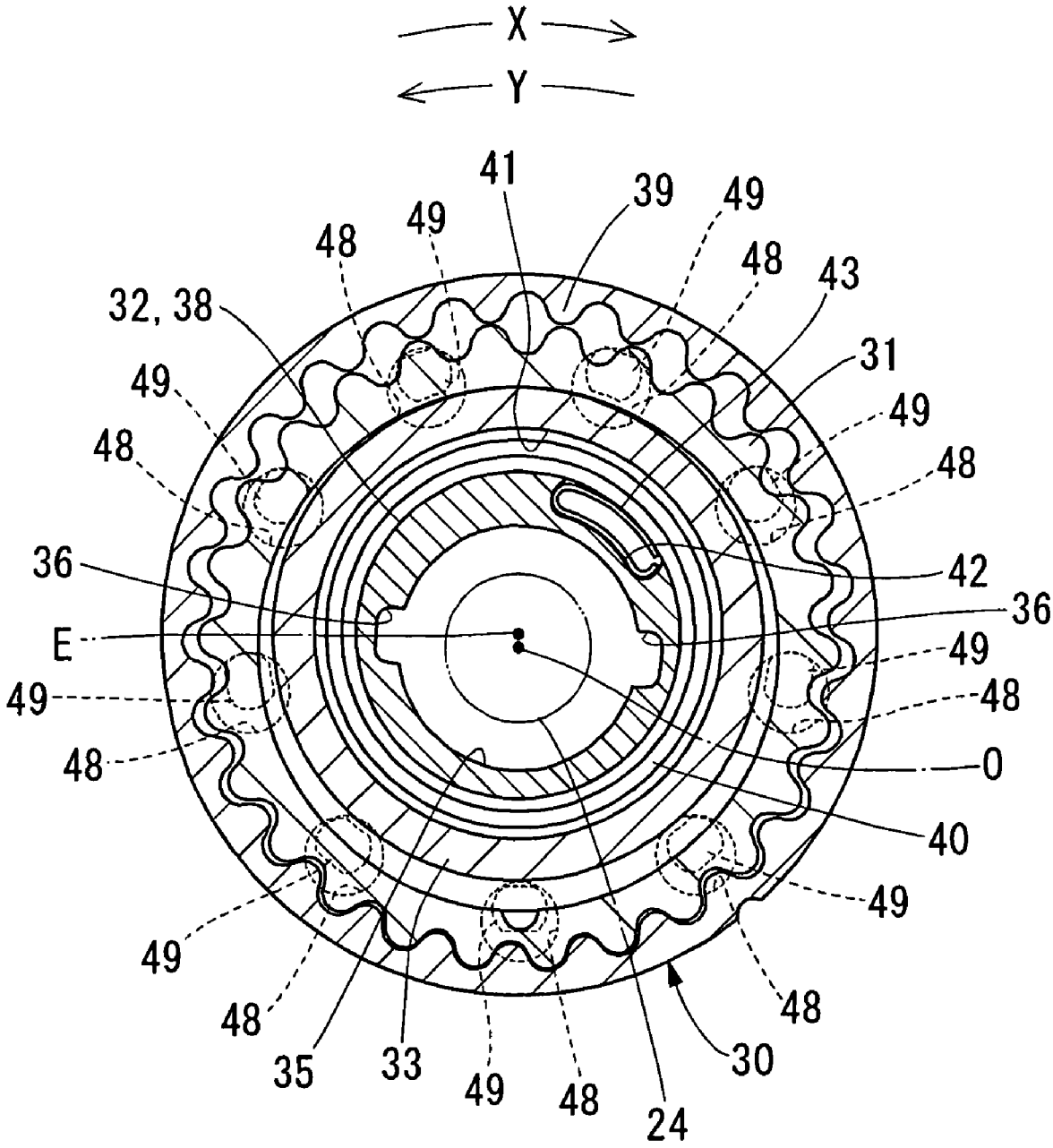
FIG. 5 is a cross sectional view taken along a line V-V in FIG. 2.

As shown in FIGS. 2 and 5, the reduction gear unit 30 includes an external gear 31, a planetary carrier 32, an internal gear 33, and a guide rotation member 34.

The external gear 31 has an addendum circle outside of a dedendum circle and is coaxially connected to the cover 12 by rivets, whereby the external gear 31 integrally rotates with the driving rotation member 10.

The planetary carrier 32 is cylindrical as a whole, and its inner surface 35 is coaxially arranged with the driving rotation member 10 and the motor shaft 24. A groove 36 is provided on the inner surface 35 to receive a joint 37 so that the planetary carrier 32 is connected to the motor shaft 24. Thereby, the planetary carrier 32 rotates around the center "O" in connection with the motor shaft 24, and is able to relatively rotate with respect to the driving rotation member 10. The planetary carrier 32 is provided with an eccentric portion 38 on its outer surface.

The internal gear 33 is a planetary gear having teeth portion 39 of which addendum circle is inside of a dedendum circle. The dedendum circle of the teeth portion 39 is larger than the addendum circle of the external gear 31. The number of teeth of the teeth portion 39 is larger than that of the external gear 31 by one tooth. The teeth portion 39 is arranged outside of the external gear 31 in such a manner as to be eccentric with respect to the external gear 31, and engages with the external gear 31 at side opposite to the eccentric direction. A center bore 41 of the internal gear 33 is coaxially arranged with the teeth portion 39. The eccentric portion 38 is engaged with the center bore 41 through a bearing 40. The internal gear 33 rotates around an eccentric center E of the eccentric portion 38 while performing a planetary motion in a rotation direction of the eccentric portion 38. A plate spring 43 having U-shape is received in a hole 42 formed in the eccentric portion 38. The plate spring 43 biases the internal gear 33 via the bearing 40 so that the internal gear 33 engages with the external gear 31 sufficiently.

As shown in FIGS. 2 and 4, the guide rotation member 34 is disc-shaped. The guide rotation member 34 is rotatably engaged with the bearing portion 20 of the driven rotation member 18. Thereby, the guide rotation member 34 is able to rotate around the center "O", and is able to relatively rotate with respect to the driving rotation member 10 and the driven rotation member 18. As shown in FIGS. 2 and 5, the guide rotation member 34 is provided with a plurality of engaging holes 48 which are arranged in a regular interval. The internal gear 33 is provided with a plurality of engaging pins 49 which are arranged in a regular interval. Each of engaging pins 49 are inserted into respective engaging hole 48 so that the torque transmission is performed from the internal gear 33 to the guide rotation member 34 while performing the planetary motion of the internal gear 33.

In the reduction gear unit 30, when the planetary carrier 32 does not rotate relative to the driving rotation member 10, the internal gear 33 does not perform the planetary motion and rotates with the driving rotation member 10. The engaging pins 49 biases the engaging holes 48 in a rotation direction. As the result, the guide rotation member 34 rotates in a clockwise direction in FIG. 5 while maintaining the same rotational phase as the driving rotation member 10.

When the planetary carrier 32 rotates in the direction "X" with respect to the driving rotation member 10, the internal gear 33 performs the planetary motion, engaging with the external gear 31. The biasing force of the engaging pins 49 increases so that the guide rotation member 34 relatively rotates in the direction "X" with respect to the driving rotation member 10.

When the planetary carrier 32 rotates in the direction "Y" with respect to the driving rotation member 10, the internal gear 33 performs the planetary motion, engaging with the external gear 31. The biasing force of the engaging pins 49 increases so that the guide rotation member 34 relatively rotates in the direction "Y" with respect to the driving rotation member 10.

According to the reduction gear unit 30 described above, by increasing the motor torque to be transmitted to the guide rotation member 34, the guide rotation member 34 is able to relatively rotate with respect to the driving rotation member 10.

Figure 6:
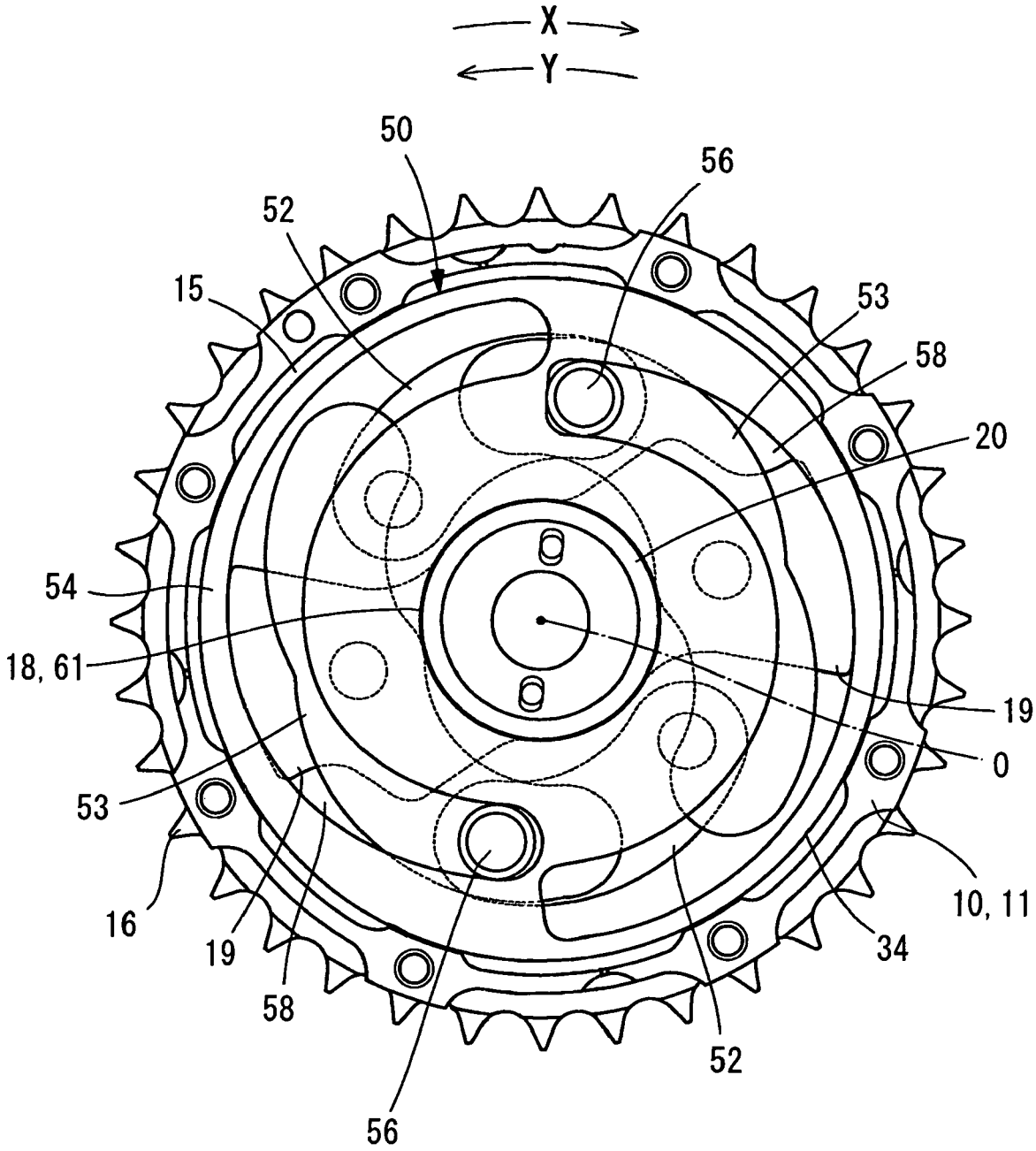
FIG. 6 is a cross sectional view showing an operation condition different from FIG. 4.

As shown in FIGS. 2 to 4 and 6, the link unit 50 includes a pair of link mechanisms 51, a groove forming portion 54, and a pair of movable shaft 56. FIGS. 2 to 4 show the link unit 50 in which the driven rotation member 18 is most retarded with respect to the driving rotation member 10. FIG. 6 shows the link unit 50 in which the driven rotation member 18 is most advanced with respect to the driving rotation member 10. In FIGS. 3, 4, and 6, hatchings which represent cross sections are omitted.

As shown in FIGS. 2 and 3, each link mechanism 51 includes a first link 52 and a second link 53. The first link 52 and the second link 53 are arranged 180° rotationally symmetrically with respect to the center "O". The first link 52 is an ark-shaped plate and is connected to the intermediate portion 15 through a shaft body 55 by a revolute pair. The second link 53 is a ω-shaped plate and is connected to corresponding first link 52 through the movable shaft 56 by a revolute pair. The second link 53 is connected to the connecting portion 19 through a shaft body 57 by a revolute pair.

As shown in FIGS. 2 and 4, the groove forming portion 54 is formed on the guide rotation member 34 opposite to the internal gear 33. A pair of guide grooves 58 are symmetrically formed in the groove forming portion 54. The guide groove 58 is inclined in such a manner that a distance from the center "O" varies along its extending direction. As shown in FIGS. 4 and 6, the guide groove 58 is a curved line of which curvature gradually varies in such a manner that the guide groove 58 is apart from the center "O" along the direction "X". The guide groove 58 has a bottom surface in order not to penetrate the guide rotation member 34 except a portion communicating to the engaging hole 48.

As shown in FIGS. 2 to 4, each of the movable shafts 56 is column-shape as a whole. The movable shafts 56 are eccentrically arranged with respect to the center "O". One end of the movable shaft 56 is slidably engaged with corresponding guide groove 58. Thereby, each of the movable shafts 56 slides in the guide groove according to the rotation of the guide rotation member 34. The other end of the movable shaft 56 is rotatable engaged with the corresponding first link 52. Thereby, the first link 52 in each link mechanism 51 connects the movable shaft 56 with the driving rotation member 10. A middle portion of the movable shaft 56 is press-fitted to the corresponding second link 53 which is connected with the connecting portion 19. Thereby, the second link 53 in each link mechanism 51 connects the movable shaft 56 with the driven rotation member 18.

While the guide rotation member 34 maintains the same rotational phase as the driving rotation member 10, the movable shaft 56 does not slide in the guide groove 58 to rotate with the guide rotation member 10. The relative position between the first link 52 and the second link 53 is unchanged, so that the driven rotation member 18 rotates in a clockwise direction in FIGS. 4 and 6 while maintaining the same rotational phase as the driving rotation member 10. Hence, the present valve timing is maintained.

When the guide rotation member 34 rotates in the "X" direction relative to the driving rotation member 10, each of movable shafts 56 slides in the guide groove 58 in such a manner as to come close to the center "O". At this time, each of the movable shafts 56 rotates the first link 52 in the corresponding link mechanism 51 and moves so that a distance between the movable shaft 56 and the center "O" decreases. As the result, the second link 53 and the connecting portion 19 are rotated in the direction "X" by a biasing force of the movable shaft 56, so tat the driven rotation member 18 is advanced with respect to the driving rotation member 10. Hence, the valve timing is advanced.

When the guide rotation member 34 rotates in the "Y" direction relative to the driving rotation member 10, each of movable shafts 56 slides in the guide groove 58 in such a manner as to be apart from the center "O". At this time, each of the movable shafts 56 rotates the first link 52 in the corresponding link mechanism 51 and moves so that a distance between the movable shaft 56 and the center "O" increase. As the result, the second link 53 and the connecting portion 19 are rotated in the direction "Y" by a retracting force of the movable shaft 56, so tat the driven rotation member 18 is retarded with respect to the driving rotation member 10. Hence, the valve timing is retarded.

In the link unit 50 described above, the rotation of the driven rotation member 18 relative to the driving rotation member 10 is generated in each link mechanism 51 according to the movement of the movable shaft 56 which follows the relative rotation of the guide rotation member 34.

As shown in FIG. 2, the driven rotation member 18 includes a connecting member 60 forming the fix portion 17 and the connecting portions 19, and a bearing member 61 forming the bearing portion 20. The connecting member 60 and the bearing member 61 are coupled to each other by a joint member 62.

Figure 7A:
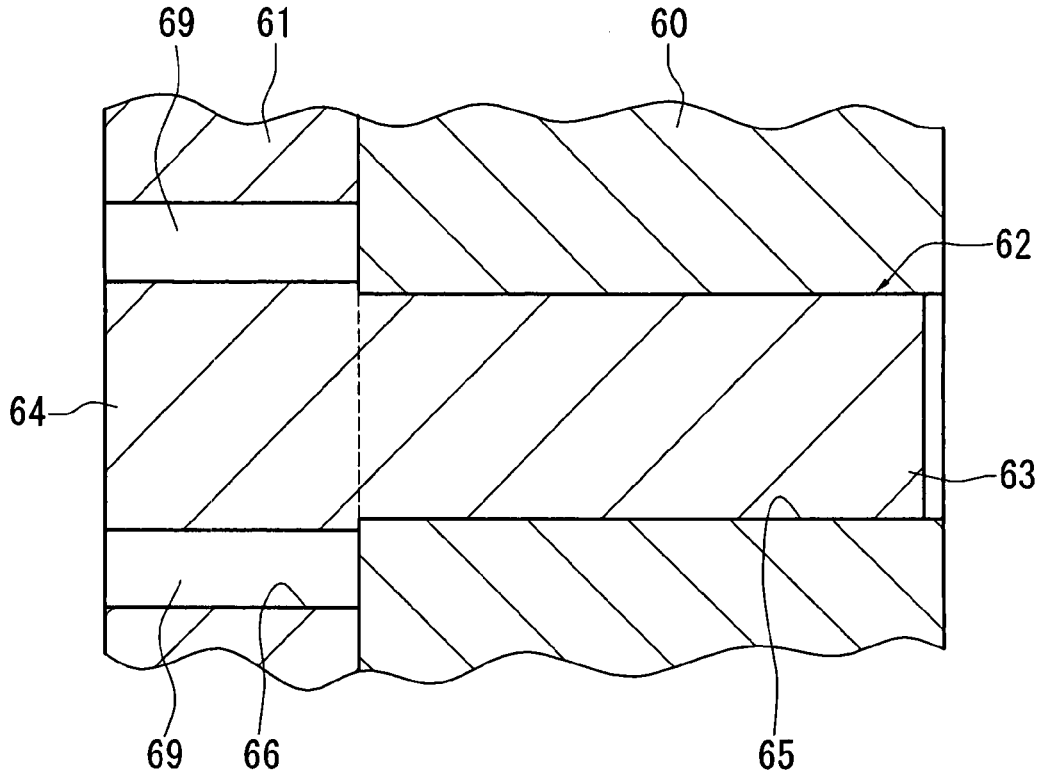
FIG. 7A is an enlarged cross sectional view showing an essential part of the first embodiment.
Figure 7B:
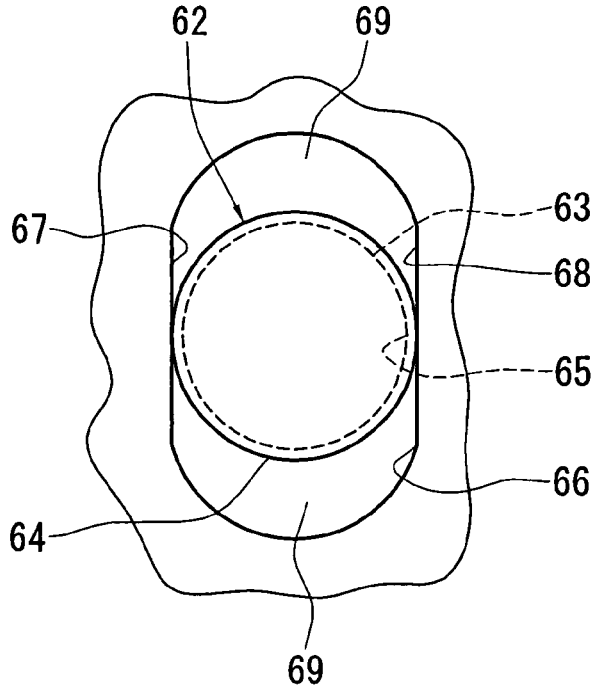
FIG. 7B is an enlarged side view showing the same part.

As shown in FIGS. 7A and 7B, the joint member 62 includes a columnar small-diameter portion 63 and a columnar large-diameter portion 64.

Figure 8:
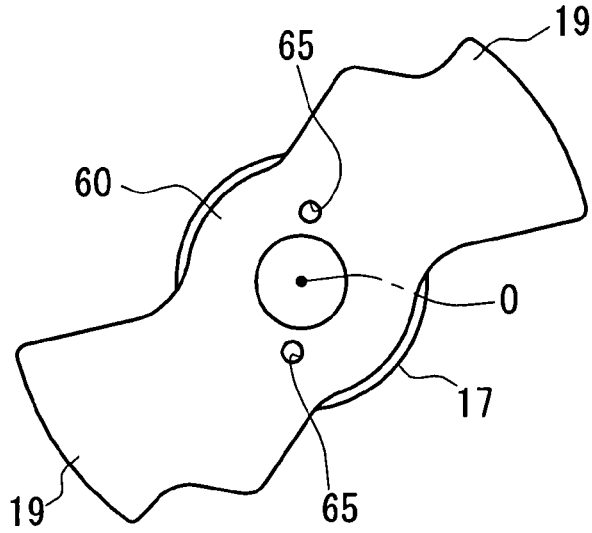
FIG. 8 is a side view showing an essential part of the first embodiment.

As shown in FIG. 8, a pair of engagement holes 65 are provided in the connecting member 60 at 180° rotational symmetrical positions. Besides, as shown in FIG. 3, a pair of ellipse insert grooves 66 are formed in the bearing member 61 at 180° rotational symmetrical positions.

As shown in FIGS. 7A and 7B, the small-diameter portion 63 is press-inserted into the corresponding engagement hole 65. The large-diameter portion 64 is press-inserted into the insert groove 66. The large diameter portion 64 abuts on side surfaces 67, 68. A space 69 is defined between the inner surface of the insert groove 66 and the outer surface of the large-diameter portion 64.

Figure 9:
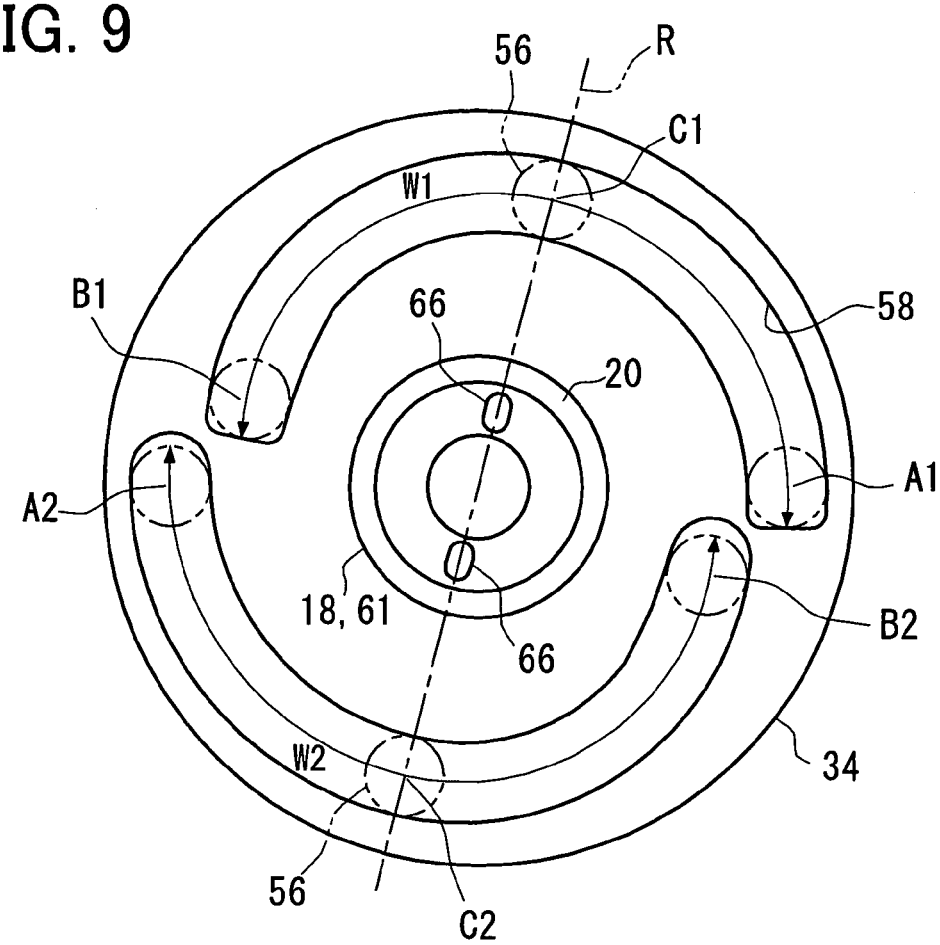
FIG. 9 is a schematic view for explaining an essential part of the first embodiment.
Figure 10:
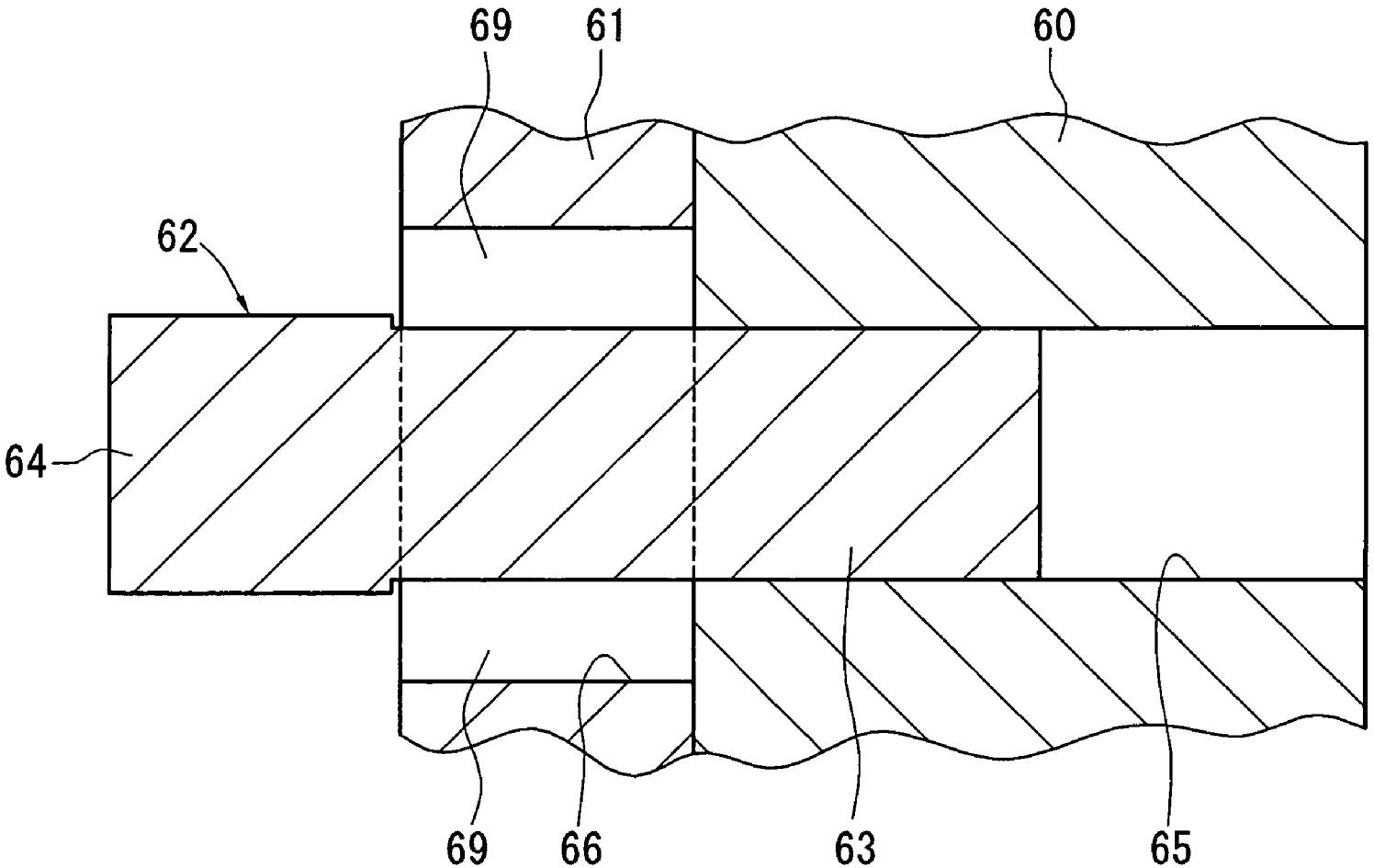
FIG. 10 is a cross sectional view for explaining a manufacturing method of the first embodiment.

As shown in FIGS. 4 and 6, when the driven rotation member 18 is most advanced or most retarded relative to the driving rotation member 10, one end of the guide groove 58 is in contact with the movable shaft 56, and the other end of the guide groove 58 is not in contact with the movable shaft 56. Thus, as shown in FIG. 9, a movable length of the movable shaft 56 in one guide groove 58 is a length W1 which is consistent with whole length of the guide groove 58. In the other guide groove 58, a movable length of the movable shaft 56 is a length W2 which is shorter than the length W1. A longitudinal axis of the insert groove 66 extends along a line R which connects center points C1 and C2 of the length W1 and W2. In FIG. 9, circles A1 and A2 represent positions of the movable shaft 56 in which the driven rotation member 18 is most retarded, and circles B1 and B2 represent positions of the movable shaft 56 in which the driven rotation member 18 is most advanced.

The connecting member 60 and the bearing member 61 are fasted to the camshaft 2 by a bolt 7. Thus, fasten force of the joint member 62 is enough to avoid deviation between the connecting member 60 and the bearing member 61 before the bolt 7 is screwed.

As schematically shown in FIG. 1, a clearance gap 80 is formed between the guide rotation member 34 and the bearing portion 20. An annular O-ring 82 is provided between the guide rotation member 34 and the bearing portion 20. The O-ring 82 circumferentially fills the clearance gap 80 in one part of its axial direction.

Next, a method of assembling the valve timing controller will be described hereinafter. First, a pair of link mechanisms 51 are provided.

Then, the guide rotation member 34 is arranged inside of the sprocket 11, and the movable shaft 56 is engaged with the guide groove 58 on the line R as shown in FIG. 1. At this time, the movable shaft 56 is brought into contact with outer side surface 84 of the guide groove 58.

After the bearing member 61 is press-fitted inside of the O-ring 82, the small-diameter portion 63 is inserted into the insert groove 66 and is press-inserted into the engagement hole 65. At this time, a press-insert amount of the small-diameter portion 63 is less than that of perfect engagement condition shown in FIG. 7A. Thereby, the large-diameter portion 64 is prevented from being inserted into the insert groove 66, and the small-diameter portion 63 is slidably engaged with the insert groove 66.

Then, the bearing member 61 is moved along the line R while the joint member 62 slides along the side surfaces 67, 68 of the insert groove 66, whereby the center of bearing portion 20 and the center of the guide rotation member 34 are precisely consistent with each other. The O-ring 82 generates alignment effect by its resilient deform.

After the alignment is completed, the small-diameter portion 63 is further press-inserted into the engagement hole 65 and the large-diameter portion 64 is press-inserted fitted into the insert groove 66. Thereby, the connecting member 60 and the bearing member 61 are coupled to each other by a joint member 62, so that the driven rotation member 18 is structured.

Then, the timing chain (not shown) is wound around the sprocket 11, and the connecting member 60 and the bearing member 61 are fasted by the bolt 70 to be connected to the camshaft 2. Since the joint member 62 is press-inserted into the insert groove 66 along the line R, it is restricted that the bearing member 61 relatively rotates with respect to the connecting member 60 and deviates from the center of the guide rotation member 34.

Finally, the reduction gear unit 30 is provided inside of the driving rotation member 10, and the cover 12 is secured to the sprocket 11 by the screws. The motor shaft 24 is connected to the planetary carrier 32, and the electric motor 21 is electrically connected to the circuit 22.

A method of defining the clearance gap 80 will be described hereinafter. In this method, a displacement of the guide rotation member 34 due to a manufacturing tolerance of the driving rotation member 10, the driven rotation member 18, the link mechanism 51, the movable shaft 56 and the guide groove 58 is considered.

Figure 11A:
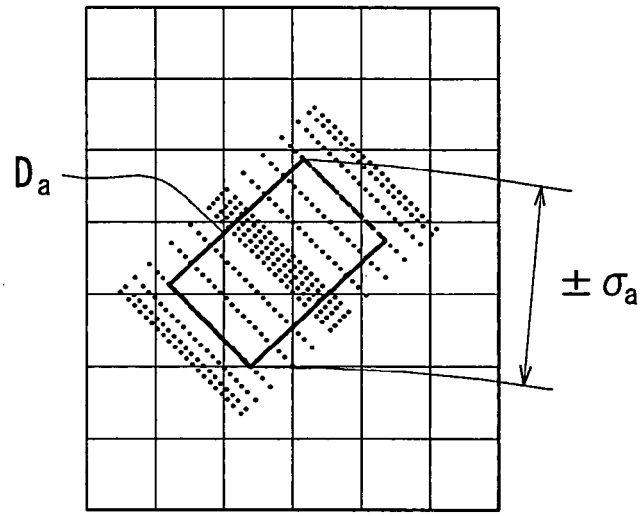
FIGS. 11A to 11C are charts for explaining a design method of the first embodiment.
Figure 11B:
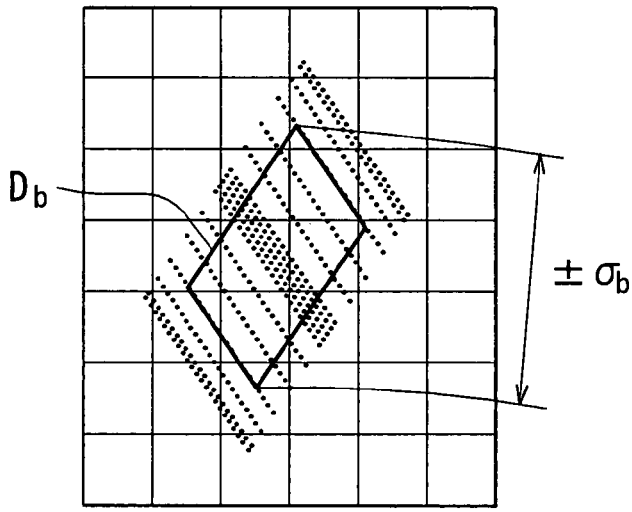
Figure 11C:
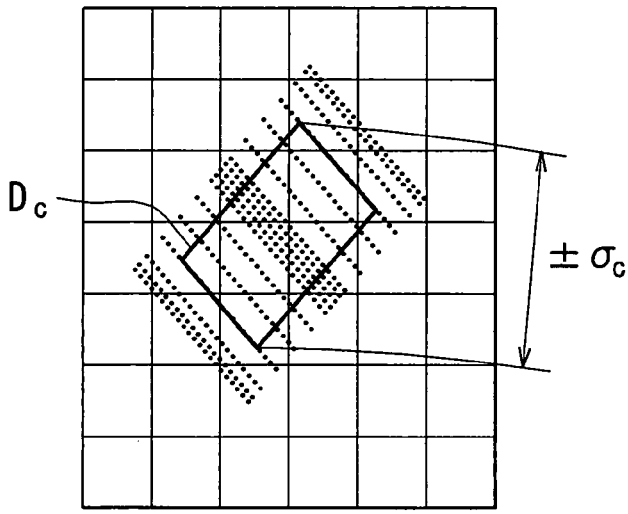

The position of the movable shaft 56 at the most retarded ends A1, A2, the most advanced ends B1, B2, and the center points C1, C2 varies as shown in FIGS. 11A, 11B, and 11C in a case that specific factors are varied in a range of the manufacturing tolerance. The specific factors are, for example, the length of the first link 52, the length of the second link 53, a clearance between the first link 52 and the shaft bodies 55, 56, a clearance between the second link 53 and the shaft bodies 55, 57, and a relative position between the shaft body 55 and the shaft body 57. In FIGS. 11A, 11B, and 11C, the vertical axes represent a direction along a radial line passing through a center of the movable shaft 56 and the center "O" at the ends A1, A2, and B1, B2, and the points C1, C2. The horizontal axes represent a direction orthogonal to the radial line.

The variation ranges of the shaft body position which should be assured are represented by rhombus areas Da, Db, and Dc in FIGS. 11A, 11B, and 11C. From two apexes in vertical direction in these areas, the assured variation amount of the shaft body position with respect to a reference position are obtained, which is denoted by ±σa, ±σb, ±σc. The reference position represents the position of the shaft body in a case that the manufacturing tolerance is zero. In this embodiment, the absolute values of the assured variation amount σa, σb, and σc satisfies following equation (1).

$$\sigma a<\sigma c<\sigma b \tag{1}$$

The alignment of the bearing member 61 and the guide rotation member 34 is conducted under the condition where the movable shaft 56 is engaged with the guide groove 58 on the radial line R passing through the center C1, C2. The assured amount σi of the guide rotation member displacement due to the variation in the shaft body position is expressed by the following equation (2).

$$\pm\sigma i=\pm(\sigma b-\sigma c) \tag{2}$$

where σc denotes an absolute value of the assured variation amount at the center points C1, C2, and σb denoted an absolute value of the assured variation amount at the most advanced ends B1, B2.

In a case that the guide groove 58 deviates leftward or rightward from the design position shown in FIG. 9, a center position of the guide groove 58 in its width direction is most deviated.

Figure 12A:
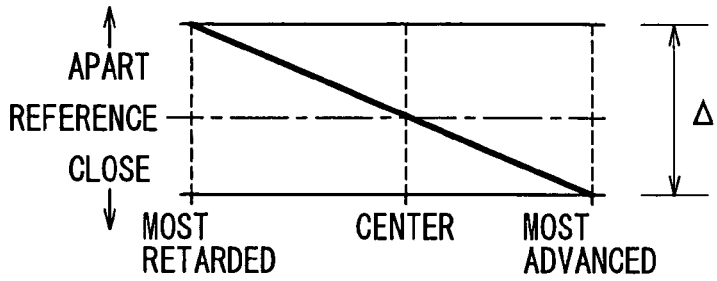
FIGS. 12A and 12B are charts for explaining a design method of the first embodiment.

When the guide groove 58 deviates rightward in the maximum amount, the center of groove is varied as shown in FIG. 12A. That is, the center position linearly varies in an apart side from the center "O" relative to the reference position between the most retarded ends A1, A2 and the center points C1, C2. The center position linearly varies in a close side to the center "O" relative to the reference position between the most advanced ends B1, B2 and the center points C1, C2. The variation width is denoted by Δ.

Figure 12B:
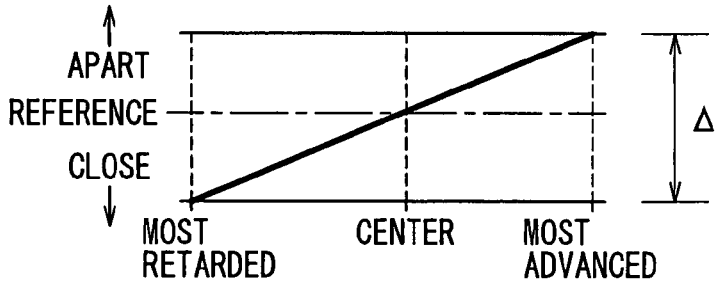

On the other hand, when the guide groove 58 deviates leftward in the maximum amount, the center of groove is varied as shown in FIG. 12B. That is, the center position linearly varies in a close side to the center "O" relative to the reference position between the most retarded ends A1, A2 and the center points C1, C2. The center position linearly varies in an apart side from the center "O" relative to the reference position between the most advanced ends B1, B2 and the center points C1, C2. The variation width is denoted by Δ.

As described above, the alignment of the bearing member 61 and the guide rotation member 34 is conducted under the condition where the movable shaft 56 is engaged with the guide groove 58 on the radial line R passing through the center C1, C2. The assured amount σii of the guide rotation member displacement due to the variation in the groove center position is expressed by the following equation (3).

$$\pm\sigma ii=\pm\Delta/2 \tag{3}$$

In the first embodiment, the width δ of the clearance gap 80 in the radial direction is defined by the following equation (4).

$$\delta=2(\sigma i+\sigma ii)=2(\sigma b-\sigma c)+\Delta \tag{4}$$

The clearance gap 80 having the width δ allows any displacement of the guide rotation member 34 in the radial direction. Hence, even if the guide rotation member 34 is displaced due to the manufacturing tolerance, this displacement is absorbed by the clearance gap 80, whereby the guide rotation member 34 does not stick on the bearing member 61 and a concentration of the load on one of the movable shafts 56 and the link mechanisms 51 is avoided. An operation lock and a reduction in strength can be avoided in the valve timing controller 1 according to the embodiment.

Besides, the assurance amounts ±σi, ±σii of the displacement can be made small value by the alignment of the bearing member 61 and the guide rotation member 34. Thus, the width δ of the clearance gap 80 is made very small, so that the bearing member 61 effectively supports the guide rotation member 34.

Second Embodiment

Figure 14:
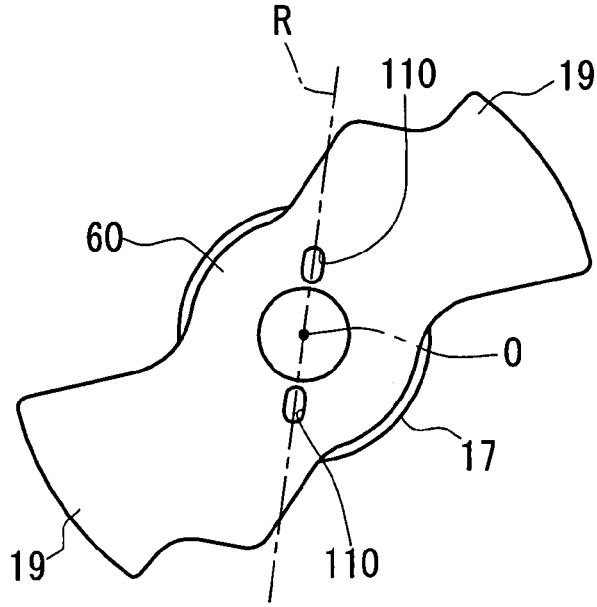
FIG. 14 is a side view showing an essential part of the second embodiment.
Figure 13:
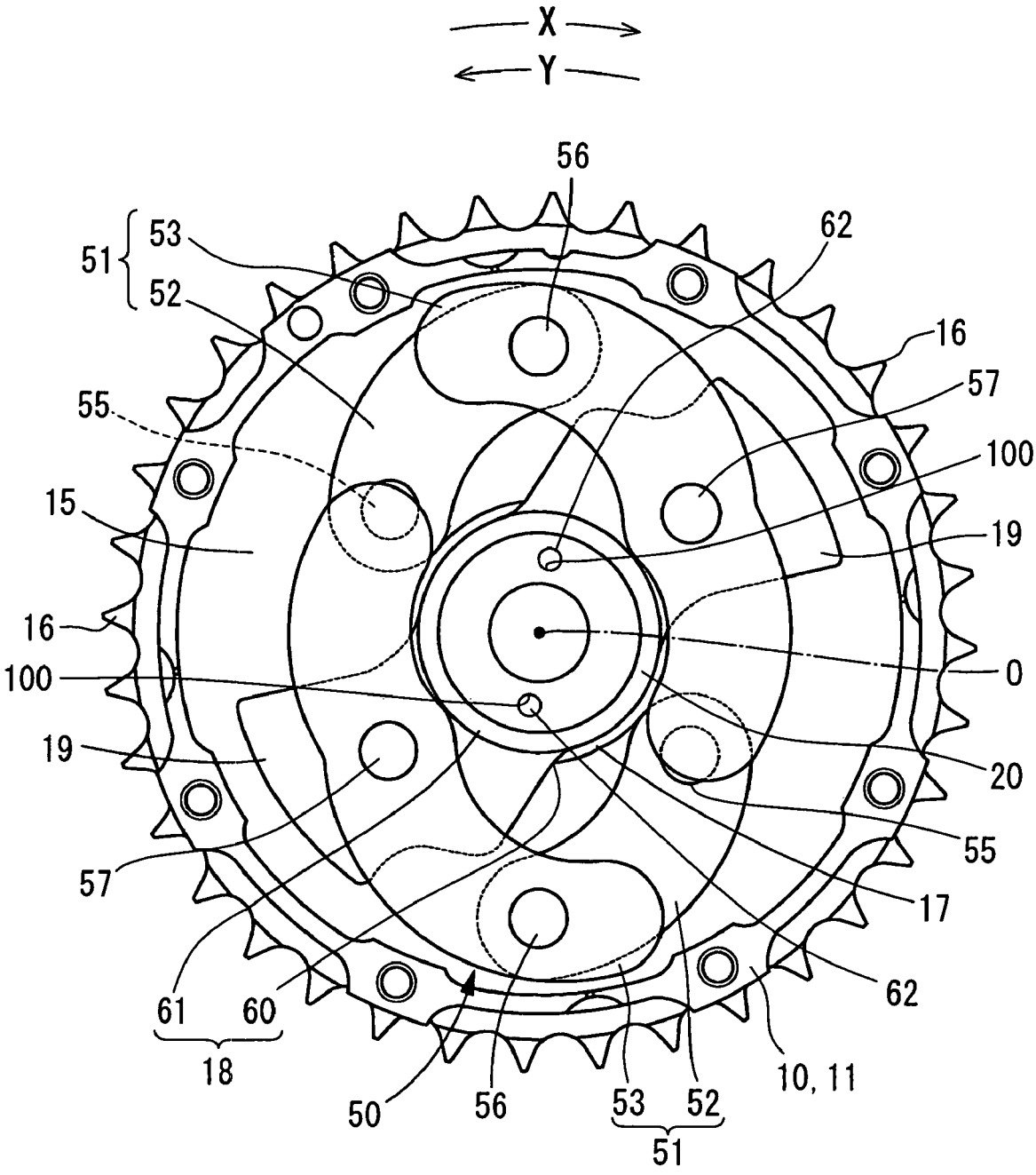
FIG. 13 is a cross sectional view showing a second embodiment.

FIGS. 13 to 15B shows a second embodiment. As shown in FIG. 13, the bearing member 61 is provided with a pair of cylindrical engagement hole 100 at 180° rotationally symmetrical positions. Besides, as shown in FIG. 14, the connecting member 60 is provided with a pair of ellipse insert grooves 110 at 180° rotational symmetrical positions. A longitudinal axis of the ellipse insert grooves 110 extends along the radial line R of the bearing member 61.

Figure 15A:
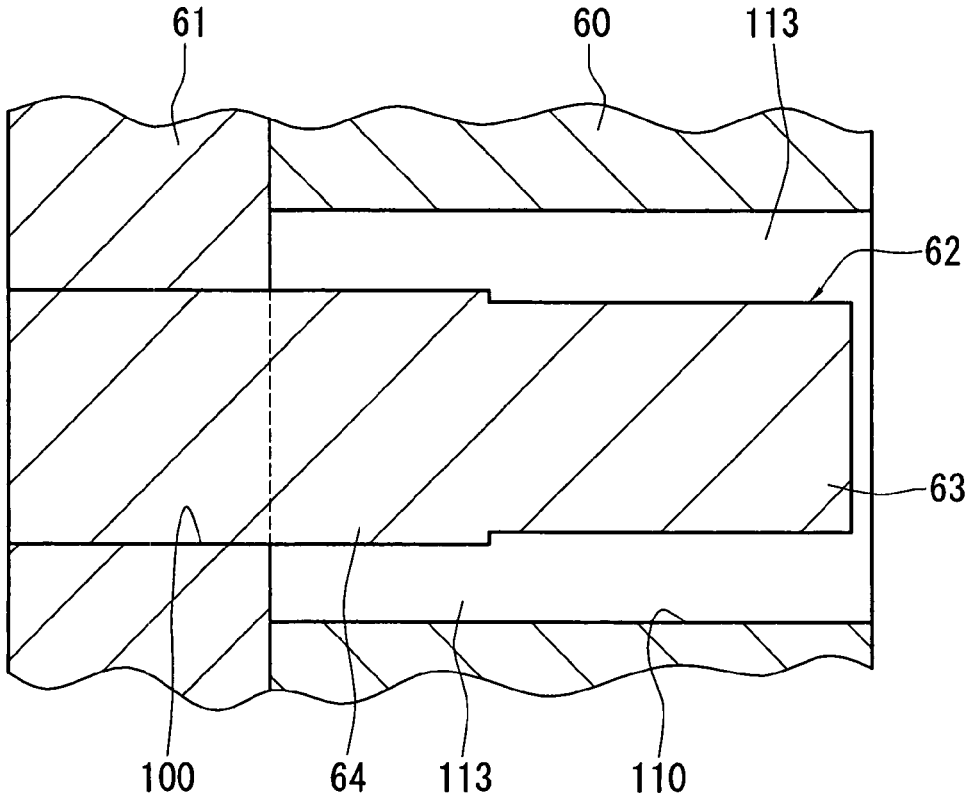
FIG. 15A is an enlarged cross sectional view showing an essential part of the second embodiment.
Figure 15B:
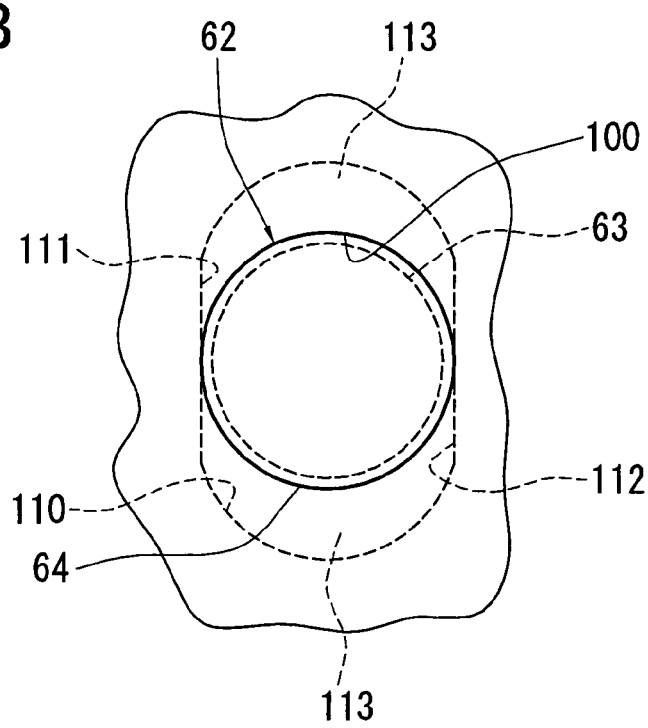
FIG. 15B is an enlarged side view showing the same part.

As shown in FIGS. 15A and 15B, the large-diameter portion 64 of the joint member 62 is press-inserted into the corresponding engagement hole 100. The large-diameter portion 64 and the small-diameter portion 63 are inserted into the insert groove 110. Especially, the large-diameter portion 64 is press-fixed in the engagement hole 100 at side surfaces 111, 112 thereof. A space 113 is defined between the inner surface of the insert groove 110 and the outer surface of the joint member 62.

Figure 16:
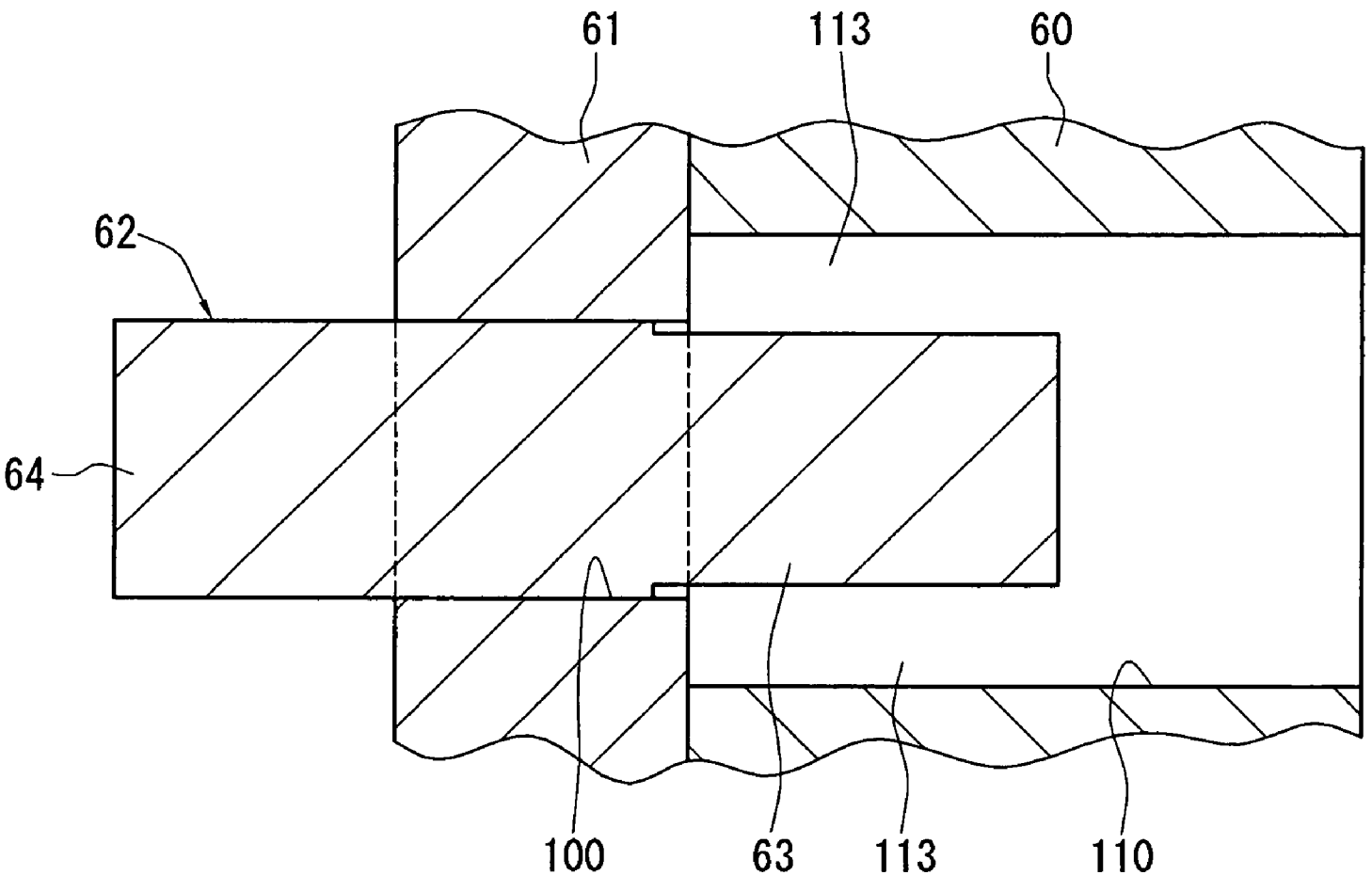
FIG. 16 is a cross sectional view for explaining a manufacturing method of the second embodiment.

After the bearing member 61 is press-inserted inside of the O-ring 82, the small-diameter portion 63 is inserted into the engagement hole 100 and the insert groove 110, and then the large-diameter portion 64 is press-inserted into the engagement hole 100 as shown in FIG. 16. The small-diameter portion 63 is able to slide on the side surfaces 111, 112 of the insert groove 110.

Then, the bearing member 61 is moved along the line R while the joint member 62 slides along the side surfaces 111, 112 of the insert groove 110, whereby the center of bearing portion 20 and the center of the guide rotation member 34 are precisely consistent with each other. After the alignment is completed, the small-diameter portion 63 is further press-inserted into the engagement hole 65 and the large-diameter portion 64 is press-inserted fitted into the insert groove 110. Thereby, the connecting member 60 and the bearing member 61 are coupled to each other by the joint member 62, so that the driven rotation member 18 is structured.

The clearance gap 80 is defined in the same manner as the first embodiment to achieve the same advantage.

Third Embodiment

Figure 17:
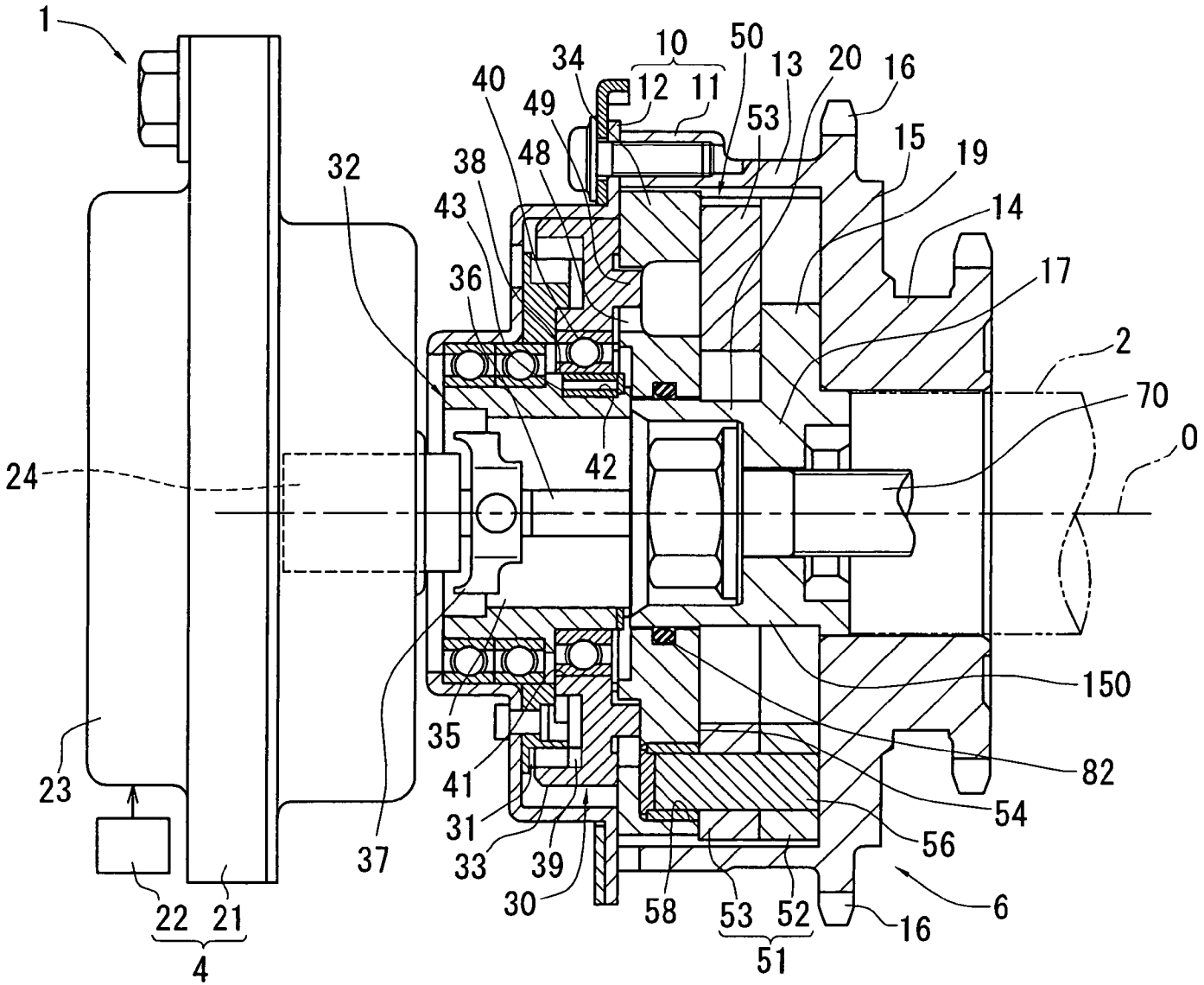
FIG. 17 is a cross sectional view showing a third embodiment.

FIG. 17 shows a third embodiment in which driven rotation member 150 is structured by a single member. While the bearing portion 20 and the guide rotation member 34 are aligned with each other by the resilient force of the O-ring 82, the movable shaft 56 is engaged with the guide groove 58. The position where the movable shaft 56 is possible to be engaged is varied in the guide range W1, W2. In the third embodiment, the way of defining the clearance gap 80 is different from that in the first embodiment.

With respect to the displacement amount of the guide rotation member 34 due to the manufacturing tolerance of the elements 10, 11, 51, 56, the assured variation amount $\pm\sigma b$, which is largest in the assured variation amounts $\pm\sigma a$, $\pm\sigma b$, and $\pm\sigma c$ shown in FIGS. 11A-11C, is set as the assured amount $\pm\sigma i$. With respect to the displacement amount of the guide rotation member 34 due to the manufacturing tolerance of the guide groove 58, the assured amount $\pm\sigma ii$ is expressed by the following equation (5). And, the width $\delta$ of the clearance gap 80 in the radial direction is defined by the following equation (6).

$$\pm\sigma ii=\pm\Delta \tag{5}$$

$$\delta=2(\sigma i+\sigma ii)=2\sigma b+2\Delta \tag{6}$$

The clearance gap 80 having the width $\delta$ allows any displacement of the guide rotation member 34 in the radial direction.

(Modifications)

The guide groove 58 can be inclined in such a manner that the distance from the center "O" increases along the direction Y. Alternatively, the guide groove 58 can be made straight groove. A common single guide groove 58 can be provided to a plurality of movable shaft 56. The movable shaft 56 can be slidably engaged with the intermediate portion 15 without providing the first link 52 and the shaft body 55.

Figure 18:
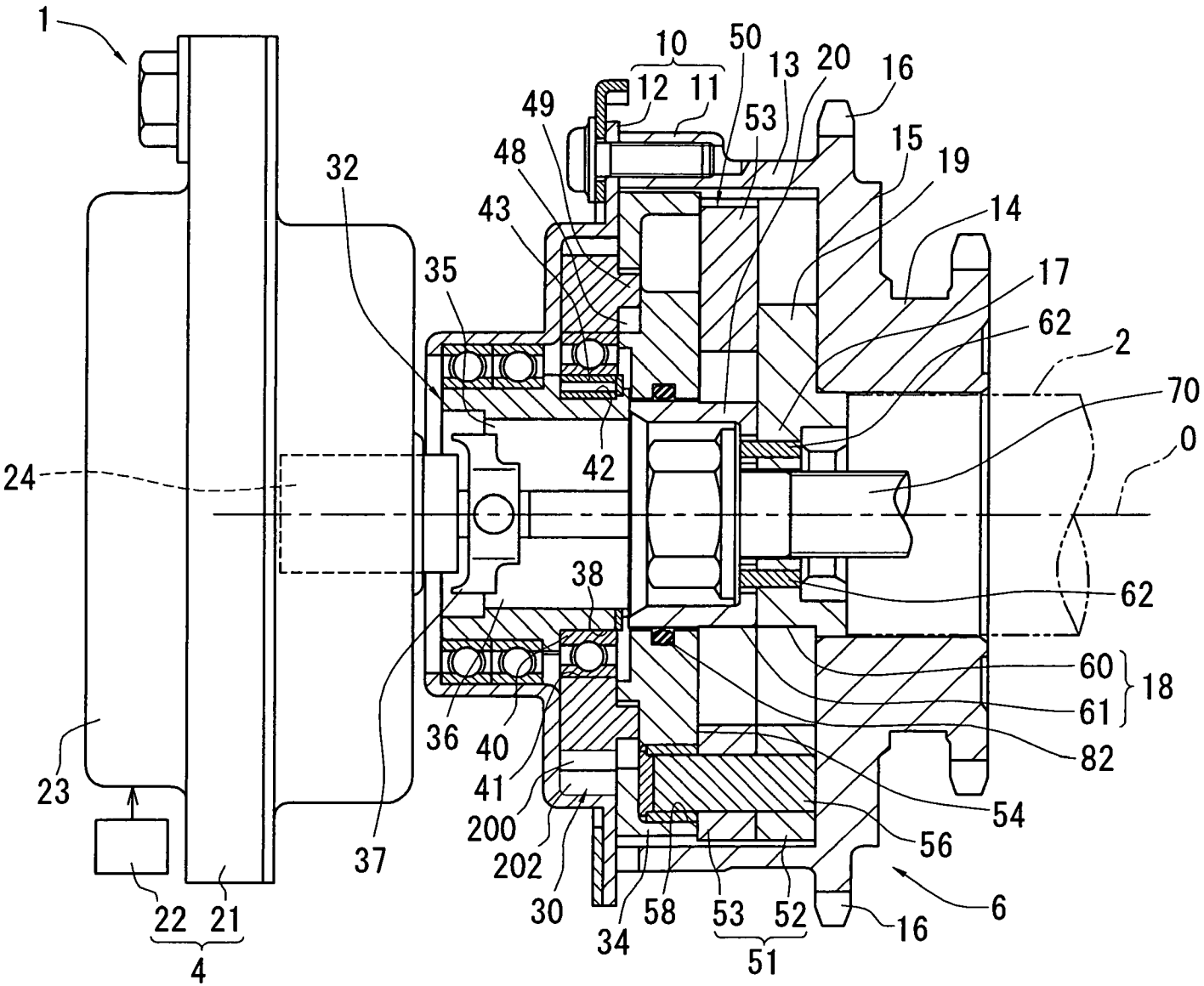
FIG. 18 is a cross sectional view showing a modification.

Furthermore, as shown in FIG. 18, it is possible that an external gear 200 having the engaging pins 49 and being supported by the planetary carrier 32 is provided instead of the internal gear 33, and the internal gear 202 engaging with the external gear 200 can be provided to the driving rotation member 10. The driving rotation member 10 can be rotated in connection with the camshaft 2, and the driven rotation member 18 can be rotated in connection with the crankshaft. The electric motor 21 can be replaced by an electromagnetic brake apparatus or a hydraulic motor.

The valve timing controller can adjust a valve timing of an exhaust valve or both of an intake valve and an exhaust valve.

What is claimed is:

1. A valve timing controller for an internal combustion engine, the valve timing controller being disposed in a system in which a torque of a crankshaft is transmitted to a camshaft which adjusts a valve timing of at least one of an intake valve and an exhaust valve, comprising:

a guide rotation member provided with a guide groove;

a bearing rotation member radially supporting the guide rotation member;

a plurality of movable bodies sliding in the guide groove in accordance with a rotation of the guide rotation member; and a plurality of link mechanisms connecting the bearing rotation member with each one of movable bodies respectively, and rotating the bearing rotation member in accordance with a movement of the movable bodies, wherein the valve timing of at least one of the intake valve and the exhaust valve is adjusted in accordance with a rotation of the bearing rotation body, and a clearance gap is provided between the guide rotation member and the bearing rotation member in order to permit a relative radial movement of the guide rotation member with respect to the bearing rotation member.

2. A valve timing controller according to claim 1, wherein one of the crankshaft and the camshaft is connected to the bearing rotation member, the other of the crankshaft and the camshaft is connected to a relating rotation member, and the link mechanisms connects the relating rotation member with the movable bodies respectively, and rotates the bearing rotation member with respect to the relating rotation member in accordance with a movement of the movable bodies.

3. A valve timing controller according to claim 1, wherein the bearing rotation member is structured by a bearing member supporting the guide rotation member and a connecting member connected to the link mechanism with a joint member.

4. A valve timing controller according to claim 3, further comprising an annular resilient member disposed between the guide rotation member and the bearing rotation member in such a manner as to fill the clearance gap.

5. A valve timing controller according to claim 3, wherein the bearing member is provided with an insert groove to receive the joint member, and the connecting member is provided with an engagement hole which is engaged with the joint member.

6. A valve timing controller according to claim 5, wherein the joint member includes a large-diameter portion and a small-diameter portion along its axial direction, and the large-diameter portion is press-inserted into the insert groove, and the small-diameter portion is press-inserted into the engagement hole.

7. A valve timing controller according to claim 5, wherein the joint member includes a large-diameter portion and a small-diameter portion along its axial direction, and the large-diameter portion is press-inserted into the insert groove and the engagement hole, and the small-diameter portion is inserted into the insert groove.

8. A valve timing controller according to claim 5, wherein the bearing member and the connecting member are connected with each other by a pair of joint member which is respectively inserted to a pair of insert grooves and is respectively engaged with a pair of engagement hole, and the insert groove extends along a radial direction line of the bearing member.

9. A valve timing controller according to claim 8, wherein the guide rotation member provided with a pair of guide groove which respectively guides a pair of movable member, and the insert groove extends along the radial direction line passing through a center of guide range of the guide groove.

10. A valve timing controller according to claim 8, wherein the bearing member and the connecting member are threaded into each other in an axial direction thereof.

11. A valve timing controller according to claim 3, wherein the connecting member is provided with an insert groove to receive the joint member, and the bearing member is provided with an engagement hole which is engaged with the joint member.

12. A valve timing controller according to claim 1, further comprising an electric motor generating torque for rotating the guide rotation member.

* * * * *